US010365612B2

(12) United States Patent
Saglini

(10) Patent No.: US 10,365,612 B2
(45) Date of Patent: Jul. 30, 2019

(54) MECHANICAL TIMEPIECE MOVEMENT WITH RUNNING RESERVE DETECTION

(71) Applicant: ETA SA Manufacture Horlogere Suisse, Grenchen (CH)

(72) Inventor: Julien Saglini, Biel/Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 144 days.

(21) Appl. No.: 15/681,458

(22) Filed: Aug. 21, 2017

(65) Prior Publication Data

US 2018/0095424 A1 Apr. 5, 2018

(30) Foreign Application Priority Data

Oct. 4, 2016 (EP) ..... 16192251

(51) Int. Cl.
*G04B 9/02* (2006.01)
*G04B 27/04* (2006.01)
(Continued)

(52) U.S. Cl.
CPC ..... *G04B 27/045* (2013.01); *G04B 1/12* (2013.01); *G04B 3/043* (2013.01); *G04B 9/005* (2013.01); *G04B 9/02* (2013.01)

(58) Field of Classification Search
CPC ..... G04B 27/045; G04B 1/12; G04B 3/043; G04B 3/04; G04B 27/04; G04B 9/005; G04B 9/02; G04B 9/00
See application file for complete search history.

(56) References Cited

U.S. PATENT DOCUMENTS 7,815,363 B2 * 10/2010 Buttet ..... G04B 17/285 368/124
7,965,585 B2 * 6/2011 Schiesser ..... G04B 21/12 116/25

(Continued)

FOREIGN PATENT DOCUMENTS

CH 698 752 B1 10/2009
CH 710 320 A2 5/2016

(Continued)

OTHER PUBLICATIONS

Description CH710320—english—translationportal.epo.org—Mar. 6, 2019.*

(Continued)

*Primary Examiner* — Sean P Kayes
(74) *Attorney, Agent, or Firm* — Oblon, McClelland, Maier & Neustadt, L.L.P.

(57) ABSTRACT

The mechanical timepiece movement with running reserve indication comprises at least one barrel system with a winding output connected to a winding wheel of a differential gear, and with an unwinding output connected to an unwinding wheel of the differential gear. It includes a locking wheel set driven in rotation by an intermediate wheel of the differential gear. The locking wheel set is connected to a running reserve indicator to display the running reserve. The locking wheel set includes a locking element for coming into contact with the unwinding wheel of the differential gear when the running reserve is at zero, in order to lock the timepiece movement.

11 Claims, 4 Drawing Sheets

(51) Int. Cl.

| | |
|---|---|
| ***G04B 1/12*** | (2006.01) |
| ***G04B 3/04*** | (2006.01) |
| *G04B 9/00* | (2006.01) |

(56) References Cited

U.S. PATENT DOCUMENTS

| | | | | |
|---|---|---|---|---|
| 8,730,768 | B2 * | 5/2014 | Goeller | G04B 9/02 368/66 |
| 9,128,464 | B2 * | 9/2015 | Sarchi | G04F 7/08 |
| 2008/0192583 | A1 * | 8/2008 | Buttet | G04B 17/285 368/127 |
| 2010/0054091 | A1 * | 3/2010 | Schiesser | G04B 13/008 368/269 |
| 2012/0243385 | A1 | 9/2012 | Goeller | |

FOREIGN PATENT DOCUMENTS

| | | |
|---|---|---|
| EP | 0 568 499 B1 | 5/1997 |
| EP | 1 760 548 A1 | 3/2007 |
| EP | 2 503 405 A1 | 9/2012 |

OTHER PUBLICATIONS

European Search Report dated Mar. 30, 2017 in European Application 16192251.3, filed on Oct. 4, 2016 (with English Translation of Categories of cited documents).

* cited by examiner

MECHANICAL TIMEPIECE MOVEMENT WITH RUNNING RESERVE DETECTION

This application claims priority from European patent application No. 16192251.3 filed on Oct. 4, 2016, the entire disclosure of which is hereby incorporated herein by reference.

FIELD OF THE INVENTION

The present invention concerns a mechanical timepiece movement provided with running reserve detection means. The timepiece movement includes at least one barrel system connected to a winding wheel of a differential gear and an unwinding wheel of the differential gear.

BACKGROUND OF THE INVENTION

A mechanical timepiece movement generally includes a barrel system driving at least one wheel at the winding output and one wheel at the unwinding output respectively connected to a winding wheel and to an unwinding wheel of a differential gear. A set of wheels connected to an intermediate wheel of the differential gear controls a running reserve display, but no element of the movement is provided for an operation to stop the movement when the running reserve is at zero.

The Patent EP 0 568 499 B1 describes a running reserve indicator device for a mechanical watch. The indicator device includes at least one star-wheel with an indicator member, which is driven in rotation during the winding or unwinding of the barrel. The indicator member makes it possible to display the running reserve of the watch. However, nothing is provided to ensure that the movement is stopped when the running reserve approaches zero.

The Patent CH 698 752 B1 describes a timepiece which includes a running reserve indicator mechanism. It includes two barrels facing each other and connected by a common arbor, which controls the running reserve display mechanism. However, nothing is provided to ensure that the movement is stopped when the running reserve approaches zero.

The Patent Application CH 710 320 A2 describes a timepiece, which includes a mechanical energy source, such as a barrel and a control member connected to a control device inside the watch case. The control device includes a running reserve wheel mounted to pivot on the frame and connected to the barrel by a differential gear so that the angular position of the running reserve wheel is dependent on the level of winding of the barrel. A control cam is mounted to pivot on the same axis as the running reserve wheel. The control cam has a hole extending in an arc of a circle inside which is housed a pin integral with the running reserve wheel. A spiral spring is mounted between the running reserve wheel and the cam. Connected to the control device, there is also provided a stop device, which includes a stop lever, for stopping the movement when the running reserve is close to zero.

SUMMARY OF THE INVENTION

It is therefore a main object of the invention to overcome the drawbacks of the prior art by proposing a mechanical timepiece movement provided with running reserve detection means and capable of stopping operation of the movement when the running reserve is close to zero.

To this end, the present invention concerns a mechanical timepiece movement provided with running reserve detection means, which includes a mechanical timepiece movement with running reserve indication, comprising at least one barrel system with a winding output connected to a winding wheel of a differential gear, and with an unwinding output connected to an unwinding wheel of the differential gear, wherein the movement includes a locking wheel set driven in rotation by an intermediate wheel of the differential gear, the locking wheel set being connected to a running reserve indicator to display the running reserve, wherein the locking wheel set includes a locking element for coming into contact with the unwinding wheel of the differential gear, when the running reserve indicator indicates zero in order to lock the timepiece movement, and wherein the locking wheel set includes a first wheel fixed on the axis of rotation and in direct contact with the intermediate wheel of the differential gear to be driven in rotation.

Particular embodiments of the mechanical timepiece movement are defined in the dependent claims 2 to 11.

One advantage of the mechanical timepiece movement lies in the fact that it is possible to use a locking wheel set, which drives the running reserve indicator to lock the movement by means of a locking element, which may be a finger disposed on the wheel set arbor. The locking wheel set is driven by an intermediate wheel of the differential gear. Preferably, the finger comes into contact with the unwinding wheel of the differential gear when the running reserve is at zero. Even with the running reserve indication at zero, the barrel of the barrel system is still sufficiently wound to allow the timepiece movement to operate for around two hours.

BRIEF DESCRIPTION OF THE DRAWINGS

The objects, advantages and features of a mechanical timepiece movement provided with running reserve detection means will appear more clearly in the following description, in a non-limiting manner, with reference to the drawings, in which.

DETAILED DESCRIPTION OF THE INVENTION

In the following description, all those components of a mechanical timepiece movement provided with running reserve detection means that are well known to those skilled in the art in this technical field will be described only in a simplified manner.

Figure 1A:
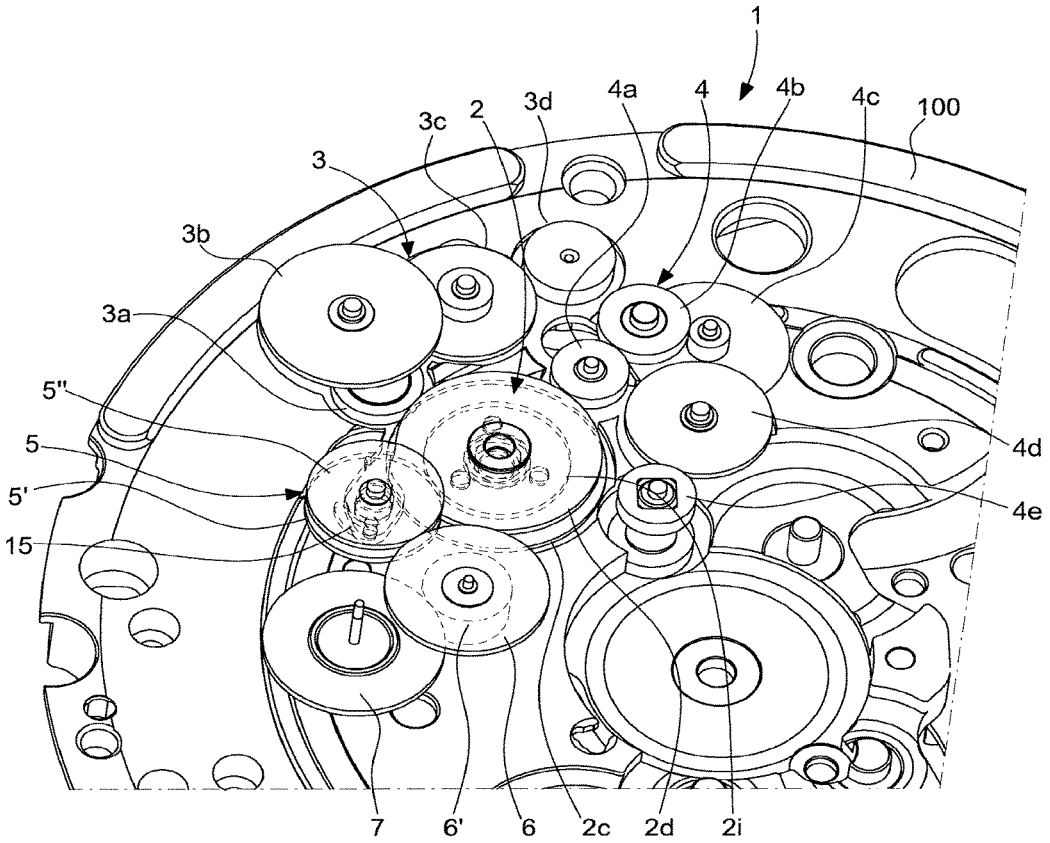
FIGS. 1*a* and 1*b* represent a three-dimensional top view of an embodiment of a mechanical timepiece movement provided with running reserve detection means according to the invention.
Figure 1B:
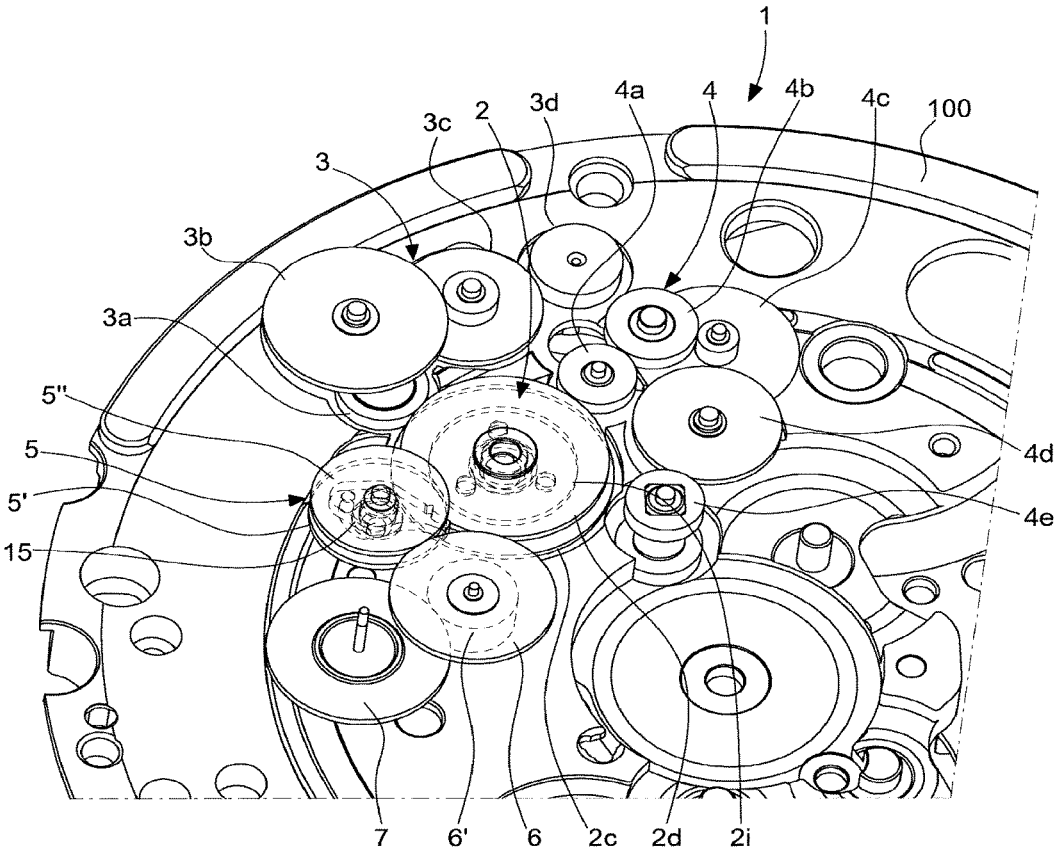
Figure 2A:
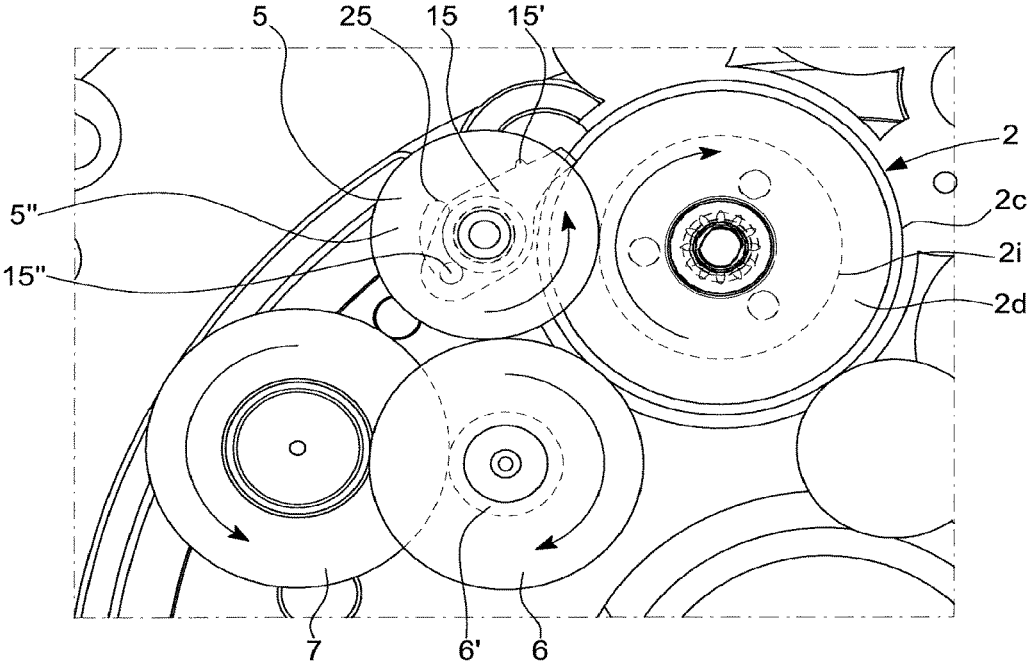
FIGS. 2*a* and 2*b* represent a more detailed top view of FIGS. 1*a* and 1*b* of the mechanical timepiece movement according to the invention.
Figure 2B:
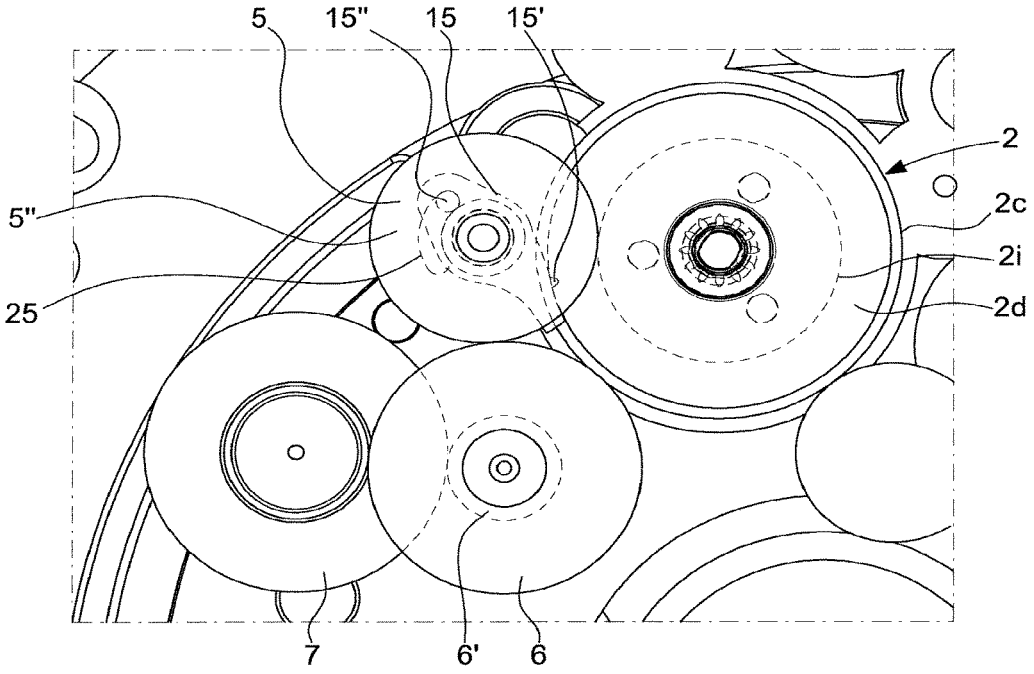
Figure 3A:
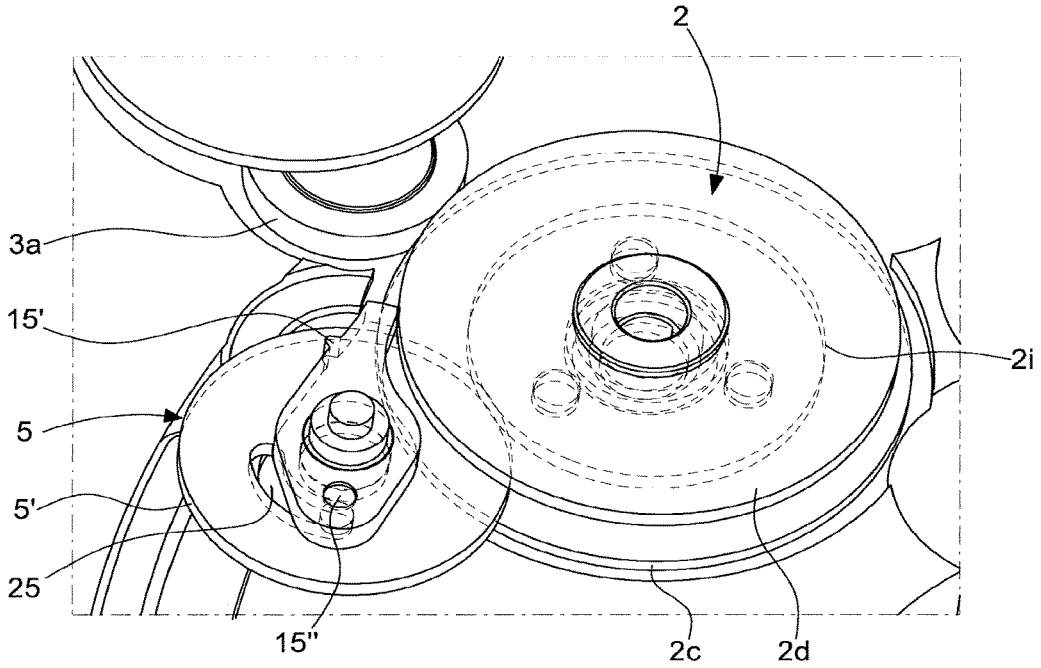
FIGS. 3*a* and 3*b* represent a partial three-dimensional view of the differential gear and of the locking wheel set in the maximum running reserve position and in the minimum running reserve position of the mechanical timepiece movement according to the invention.
Figure 3B:
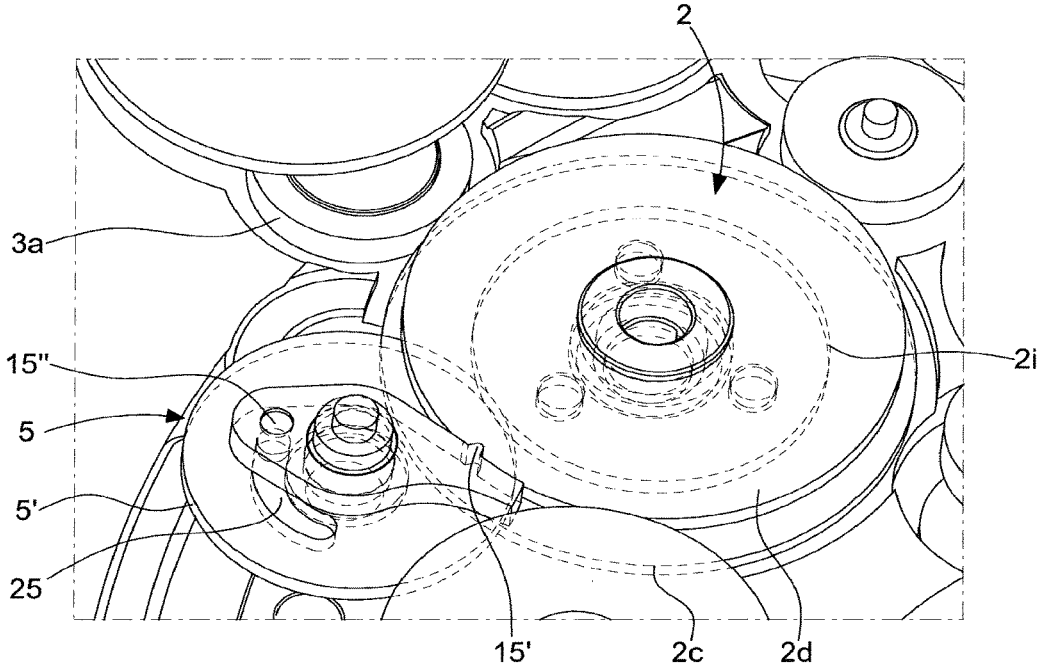

FIGS. 1*a* and 1*b* represent a three-dimensional top view of certain components of mechanical timepiece movement 1 in a normal operating position in FIG. 1*a* and in a position locking the movement in FIG. 1*b*. Mechanical timepiece movement 1 includes at least one barrel system (not represented), which may be disposed on one face of a watch plate of the movement or of another support plate. This barrel system may be a well-known system with a single barrel or two barrels, and having a winding output and an unwinding output for driving, in particular, a time base gear train (not represented).

Mechanical timepiece movement 1 includes, for example, on one face of a watch plate 100 or of another support plate, a differential gear 2 mounted to rotate about a rotational axis and respectively connected to the winding output and to the unwinding output of the barrel system. Differential gear 2 is connected directly or via a rotational speed reducing stage or reducing chain 3, 4 to the winding output and to the unwinding output of the barrel system. Preferably, differential gear 2 can be connected via a rotational speed reducing stage 3, 4 to the winding output and to the unwinding output of the barrel system in order to reduce the rotation for the running reserve detection explained below. From the unwinding output of the barrel system, a set of wheels, for example gear wheels 4*a*, 4*b*, 4*c*, 4*d*, 4*e*, may be provided between an unwinding output wheel of the barrel system and different gear 2. Of course, for winding the barrel system, a set of wheels, for example gear wheels 3*a*, 3*b*, 3*c*, 3*d* may be used between a winding member and the winding output of the barrel system, which forms a speed increasing stage in this direction.

Differential gear 2 includes a first winding wheel 2*c* and a second unwinding wheel 2*d* preferably disposed on the same axis of rotation as first winding wheel 2*c*. Differential gear 2 further includes an intermediate wheel 2*i* between winding wheel 2*c* and unwinding wheel 2*d* and in contact with the winding wheel and the unwinding wheel particularly via a ball or roller bearing arrangement. First winding wheel 2*c* can drive a first wheel 3*a* of the set of winding wheels 3, whereas second unwinding wheel 2*d* can be driven in rotation by the last wheel 4*a* of the set of unwinding wheels 4.

In normal operation of the timepiece movement after an operation to wind the barrel system, winding wheel 2*c* remains immobile without rotating, whereas unwinding wheel 2*d* is rotating. In this manner, intermediate wheel 2*i* is driven in rotation in the same direction as unwinding wheel 2*d*, but at a lower rotational speed than the rotational speed of unwinding wheel 2*d*. However, for an operation to wind the barrel system, winding wheel 2*c* is driven in an opposite direction of rotation to the direction of rotation of the unwinding wheel. This has the consequence of also driving intermediate wheel 2*i* in the direction of rotation of winding wheel 2*c*, given that the rotation generated at winding wheel 2*c* is greater in this case than the rotation of unwinding wheel 2*d*.

As also shown in FIGS. 2*a*, 2*b*, 3*a* and 3*b*, intermediate wheel 2*i* of differential gear 2 is connected to a locking wheel set 5. This locking wheel set 5 can turn about an axis of rotation from a maximum running reserve position represented in FIGS. 2*a* and 3*a*, to a zero running reserve position, which is a position locking the timepiece movement, represented in FIGS. 2*b* and 3*b*.

Locking wheel set 5 includes a first wheel 5', which is fixed on the axis of rotation. This first wheel 5' is in contact with intermediate wheel 2*i* of differential gear 2 and driven by said intermediate wheel 2*i*. First wheel 5' may include a toothing for meshing with a toothing of intermediate wheel 2*i*. Locking wheel set 5 may also include a second wheel 5" fixed on the axis of rotation and disposed coaxially above and parallel to first wheel 5'. This second wheel 5" is arranged to be connected directly to a running reserve indicator 7, or via a drive wheel 6, 6' to running reserve indicator 7.

It is to be noted that locking wheel set 5 may also comprise only one wheel 5' in contact with intermediate wheel 2*i* of the differential gear, and connected directly to running reserve indicator 7 or via drive wheel 6, 6' to running reserve indicator 7.

Locking wheel set 5 also includes a locking element 15 mounted on the axis of rotation and intended to come into contact with unwinding wheel 2*d* of differential gear 2 to stop the movement, when the running reserve is at zero. Locking element 15 is preferably disposed between first wheel 5' and second wheel 5" of locking wheel set 5. This locking element may take the form of a finger 15 with one portion 15' in contact with unwinding wheel 2*d* in the locking position. This contact portion 15' is preferably a tooth 15' that is inserted between two teeth of a toothing of unwinding wheel 2*d* of differential gear 2 to lock the movement.

Finger 15 could also be mounted to rotate freely on the axis of rotation and further provided with a lug 15" disposed inside a banana-shaped aperture 25 made in first wheel 5' of locking wheel set 5. During the rotation of intermediate wheel 2*i* of the differential gear, lug 15" of finger 15 moves into abutment on one end of banana-shaped aperture 25 of first wheel 5', which makes it possible to drive finger 15 from the maximum running reserve position, represented in FIGS. 1*a*, 2*a* and 3*a*, to the zero running reserve position, represented in FIGS. 1*b*, 2*b* and 3*b*, which corresponds to a position locking the timepiece movement. Banana-shaped aperture 25 describes an arc of a circle about the axis of rotation of locking wheel set 5, for example at an angle of between 10° and 60°.

In an embodiment that is not represented, the locking element may be made on first wheel 5' projecting in the form of a catch, which is intended to come into contact with unwinding wheel 2*d* of the differential gear in the locking position when the running reserve is at zero.

According to the embodiment presented in FIGS. 1*a*, 1 *b*, 2*a* and 2*b*, drive wheel 6 is driven in rotation by second wheel 5" of locking wheel set 5. The periphery of this drive wheel 6 may include a toothing for meshing with an outer toothing formed at the periphery of second wheel 5". A central pinion 6' of drive wheel 6 of smaller diameter comes into contact with a display wheel 7 of the running reserve indicator. Central pinion 6' includes a toothing for meshing with a toothing of running reserve indicator display wheel 7. A hand may be arranged fixed on the axis of rotation of display wheel 7 mounted on watch plate 100. The running reserve indicator hand may be observed on a watch dial for the running reserve indication.

From the description that has just been given, several variant embodiments of the mechanical timepiece movement with running reserve detection means may be devised by those skilled in the art without departing from the scope of the invention defined by the claims. The locking element of the locking wheel set may also be driven in a rectilinear manner by the first wheel of the locking wheel set in order to lock the unwinding wheel of the differential gear when the running reserve is at zero. The timepiece movement may take the form of a module with all the elements disposed inside said module.

What is claimed is:

1. A mechanical timepiece movement with running reserve indication, comprising at least one barrel system with a winding output connected to a winding wheel of a differential gear, and with an unwinding output connected to an unwinding wheel of the differential gear, wherein the movement includes a locking wheel set driven in rotation by an intermediate wheel of the differential gear, the locking wheel set being connected to a running reserve indicator to display the running reserve, wherein the locking wheel set includes a locking element for coming into contact with the unwinding wheel of the differential gear, when the running reserve indicator indicates zero in order to lock the timepiece movement, and wherein the locking wheel set includes a first wheel fixed on the axis of rotation and in direct contact with the intermediate wheel of the differential gear to be driven in rotation.

2. The mechanical timepiece movement according to claim 1, wherein the locking wheel set drives the running reserve indicator via a drive wheel.

3. The mechanical timepiece movement according to claim 2, wherein the drive wheel drives in rotation a display wheel of the running reserve indicator.

4. The mechanical timepiece movement according to claim 1, wherein the locking wheel set includes a second wheel mounted and fixed on the axis of rotation coaxially and parallel to the first wheel, and wherein the second wheel drives the running reserve indicator via a drive wheel.

5. The mechanical timepiece movement according to claim 1, wherein the locking element of the locking wheel set is in the form of a finger with a portion in contact with the unwinding wheel in the locking position.

6. The mechanical timepiece movement according to claim 5, wherein the contact portion is a tooth that is inserted between two teeth of a toothing of the unwinding wheel of the differential gear in the position locking the movement.

7. The mechanical timepiece movement according to claim 5, wherein the finger is mounted on the axis of rotation of the locking wheel set.

8. The mechanical timepiece movement according to claim 7, wherein the finger includes a lug disposed inside an aperture in an arc of a circle made inside a first wheel fixed on an axis of rotation, the first wheel being in direct contact with the intermediate wheel of the differential gear to be driven in rotation.

9. The mechanical timepiece movement according to claim 8, wherein the banana-shaped aperture describes an arc of a circle about the axis of rotation of the locking wheel set, and wherein the finger rotates freely on the axis of rotation and is driven in rotation on the first wheel via the lug thereof in contact with one end of the banana-shaped aperture of the first wheel.

10. The mechanical timepiece movement according to claim 8, wherein the finger is disposed between the first wheel of the locking wheel set and a second wheel of the locking wheel set, which drives a drive wheel in contact with the running reserve indicator.

11. The mechanical timepiece movement according to claim 1, wherein the locking element of the locking wheel set is made on the first wheel projecting in the form of a catch intended to come into contact with the unwinding wheel of the differential gear in the locking position, when the running reserve is at zero.

* * * * *